US006224285B1

(12) United States Patent
Nichols

(10) Patent No.: US 6,224,285 B1
(45) Date of Patent: May 1, 2001

(54) BUILDING LAYOUT MARKER

(76) Inventor: Roy D. Nichols, 530 S. Lake Dr., Cadillac, MI (US) 49601

( * ) Notice: Subject to any disclaimer, the term of this patent is extended or adjusted under 35 U.S.C. 154(b) by 0 days.

(21) Appl. No.: 09/324,595

(22) Filed: Jun. 3, 1999

(51) Int. Cl.[7] ..... B05C 17/00

(52) U.S. Cl. ..... 401/208; 401/48; 401/35; 101/328; 33/36

(58) Field of Search ..... 401/208, 48, 193, 401/218, 35, 21, 22; 101/111, 328, 329, 367; 33/36, 37, 38

(56) References Cited

U.S. PATENT DOCUMENTS 3,546,779 * 12/1970 Klein ..... 33/38
4,669,905 * 6/1987 Hanna ..... 401/208
4,794,857 * 1/1989 Waters et al. ..... 401/208

* cited by examiner

*Primary Examiner*—David J. Walczak

(57) ABSTRACT

The present invention is a method and apparatus for systematic marking for a member placement or nailing schedule used in the construction industry specific and system marking in general. The use of a roller wheel with an outer circumference dimension with incorporated use of marking felt tip pens projecting past the roller wall to deposit said marks when rolled along a building member for placement of studs, floor systems or roof members at equally spaced intervals.

6 Claims, 3 Drawing Sheets

BUILDING LAYOUT MARKER

BACKGROUND OF THE INVENTION

In the construction industry of residential and commercial building, it is frequently necessary to measure repetitive standard distances to ensure proper placement of joists, studs, rafters, trusses along a horizontal member, as would be the case of a sill or plate to which members are to be affixed.

The traditional layout by means of a tape measure or other measuring device would require a great, time consuming chore with extreme probability of error and a difficult task for an untrained person to accomplish.

The objects are to provide a means of making periodic marks upon the surface of two plates to substantially reduce the possibility of human error increases productivity, and provide a means for an untrained person to accomplish an important task with minimal variance for error.

Another object of the invention is no refill or messy liquid to spill. The changing of self contained marking pens keeps it simple, easy and clean.

And another object of the invention is a simplified design and construction, light weight and compact.

And a further object of the invention is an improved marking apparatus which is relatively maintenance free and relatively inexpensive to manufacture.

Additional objects and features of this invention will become apparent as the drawings and detailed description following will show the most obvious simple form of the invention.

BRIEF SUMMARY OF THE INVENTION

This invention relates to marking devices and more specific to marking devices used in the construction trades that require systematic placement of building members.

DETAILED DESCRIPTION

Figure 1:
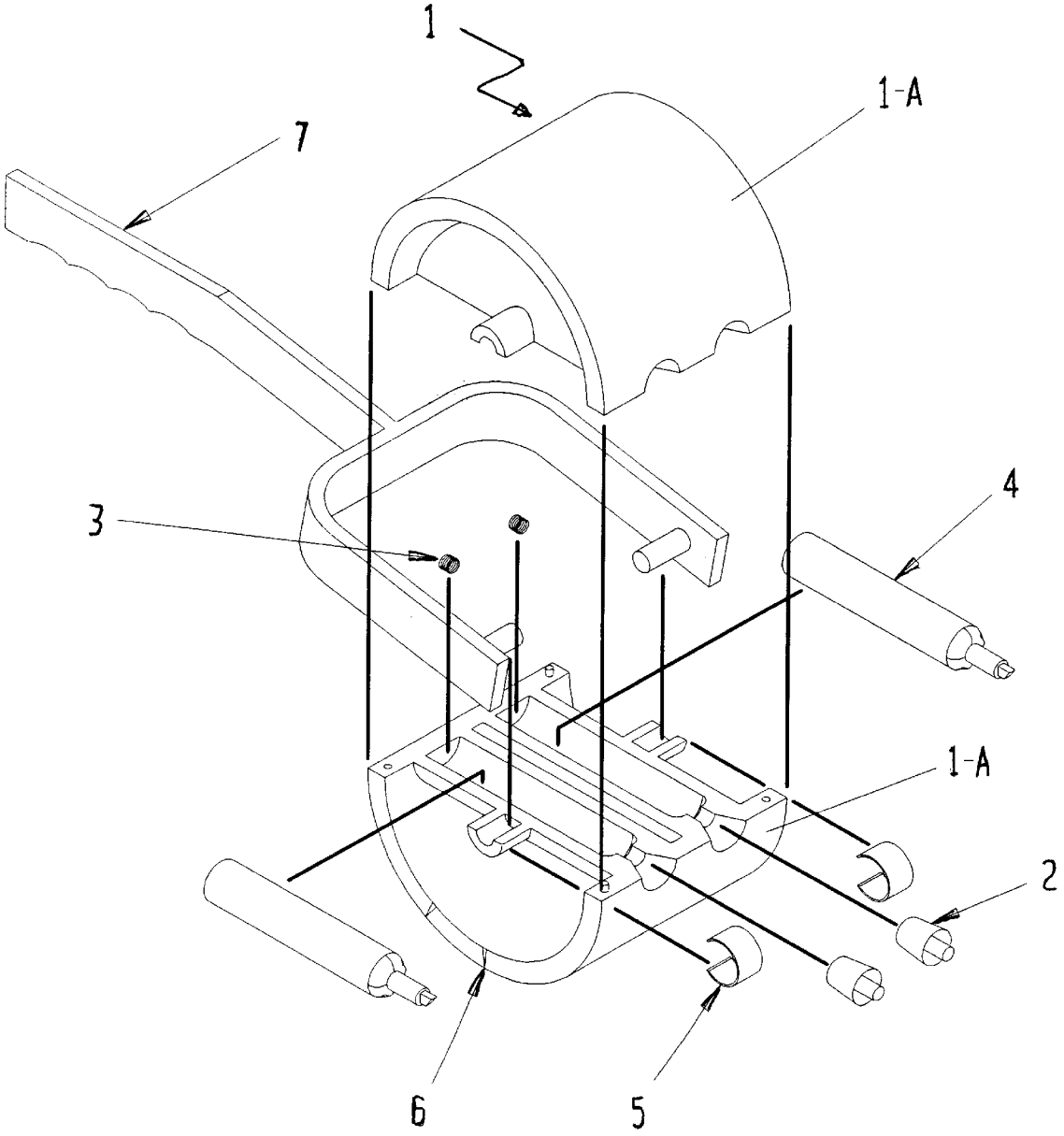
FIG. 1 An exploded perspective view

In reference now to the drawings in which like reference characters indicate corresponding elements throughout the views.

FIG. 1 shows an exploded view of the construction device of the of the present invention. The device includes a roller 1 comprised of a pair of roller housing elements 1A, receiving grooves 1B positioned on opposite sides of the roller wherein each grooves has a portion thereof positioned on one of the housing elements 1A, a pair of marking instruments 4 (which can be of differing colors) positioned within the roller, a pair of retaining clips 5 for securing the roller housing elements together and a handle member 7 attached to the roller via the receiving grooves 1B. The circumference of the roller can be 12, 16, 19, 3/16 or 24 inches.

Figure 2:
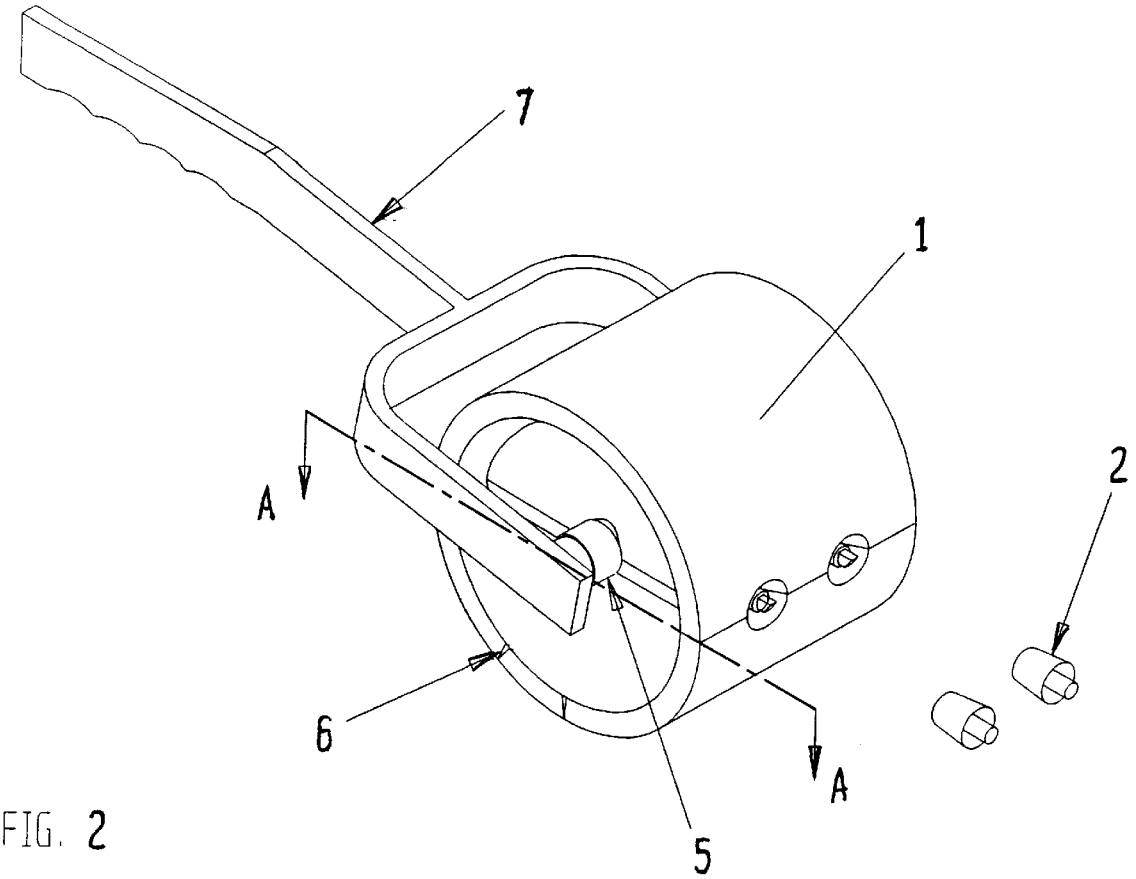
FIG. 2 A perspective view
Figure 3:
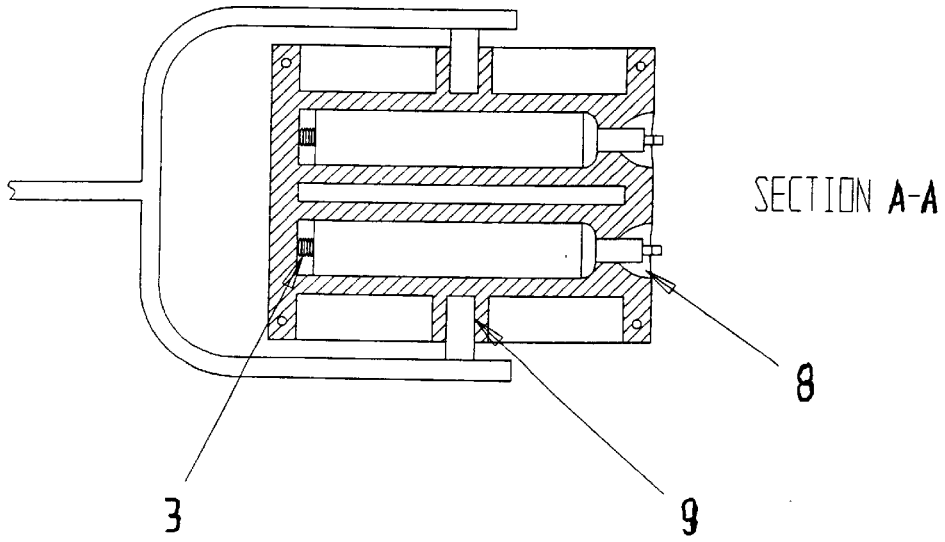
FIG. 3 A cut-away view—taken at A—A of FIG. 2
Figure 4:
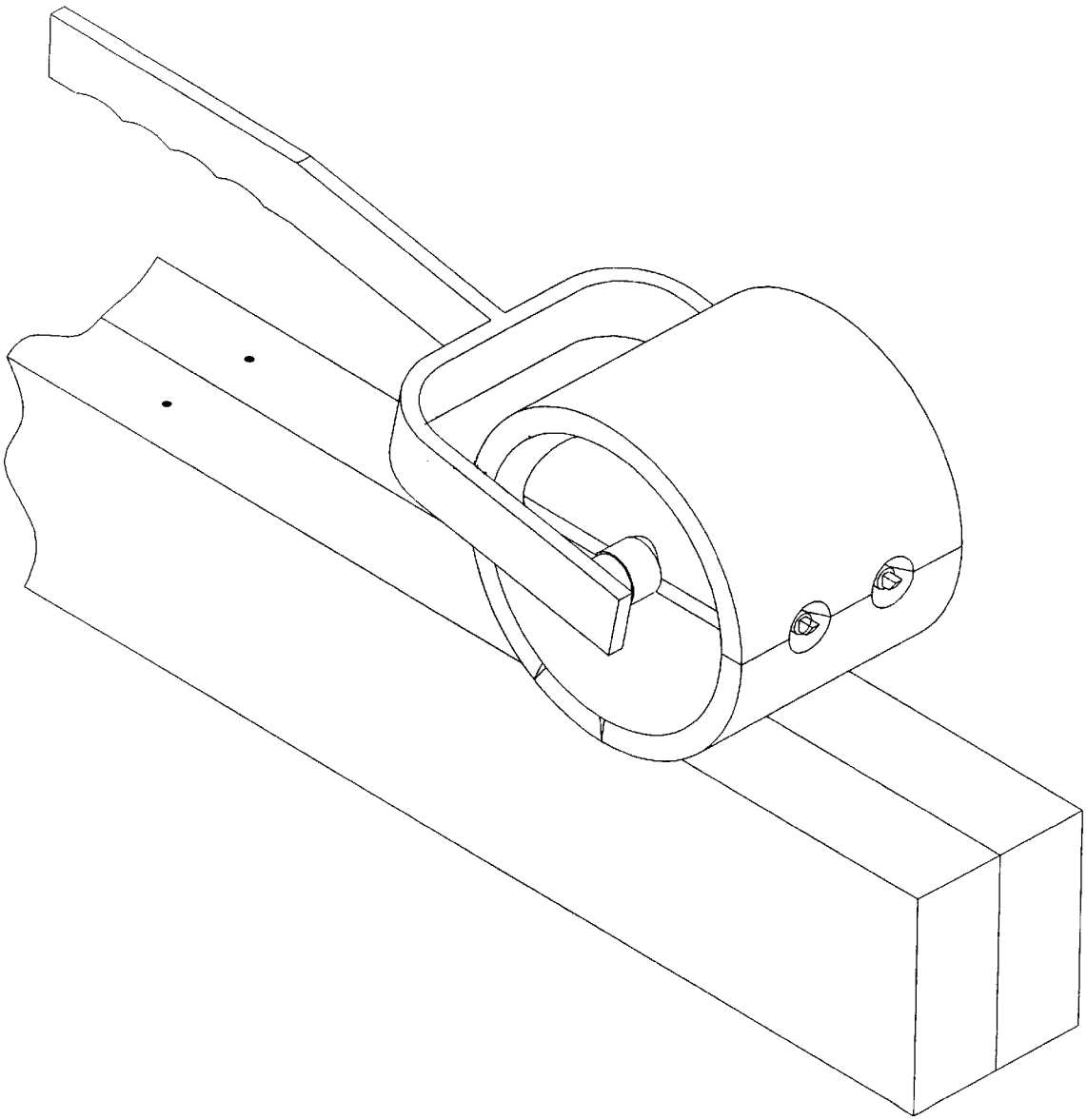
FIG. 4 A perspective view of the invention in use

FIG. 2 illustrates the simplest instrument of the present invention. The handle 7 enables the roller assembly 1 to place dots at precise intervals on standard materials used in the construction industry. The dots designating locations to space studs, rafters or joist on intersecting member or plates is provide by self-contained ink, felt tip markers 4.

FIG. 1 provides a means of an uniformed method of spacing accurately and repeatedly center positions of studs, rafters, joist. Roller 1 of the layout device has a circumference equal to the desired centering spaces. Specific mark 6 on the edge of roller 1 will designate and make allowance for the corresponding size of the designated wall plate width at the corners of the building perpendicular of the plates being marked. Mark 6 will reduce the possibility of human error which is often the case when using numerical measuring devices. Marking devices 4 are placed in channels 1C in the roller 1 and held in a pressure advance by a spring device 3.

The entire circumference of the roller 1 is designed to have a length corresponding to the standard center to center distance between components for systematic layout of the building structure.

In FIG. 1, the handle 7 is placed in the receiving groves in roller 1. Roller housing elements 1A are aligned and applying retainer clips 5 are the means to hold the embodiment as one unit.

The channels 1C have enlarged ends on the surface of the roller 1 to allow the marker caps 2 to be installed when roller device is not in use to accomplish extending the useful life of the marker.

The marking device being compact of nature would allow it to be carried or stored in a easily handled tool box. Also the marking device is made of a lightweight durable material. Be it aluminum or plastic composite.

Although the invention has been shown and describe in the most practical and desired situations, it is recognized that there are many applications in the scope of construction which would allow the invention to be useful, handy and a time saver.

What is claimed is:

1. A construction device for marking a layout of a building structure comprising:

a roller comprised of a pair of roller housing elements, said roller having a plurality of channels therein wherein each channel has an enlarged opening on a surface of said roller, said roller further including a pair of receiving grooves positioned on opposite sides of said roller, a portion of each receiving groove being positioned on one of said roller housing elements;

a marking instrument positioned in each of said channels wherein each marking instrument includes a writing tip which projects through said enlarged opening and beyond an outer surface of said roller to enable said marking instrument to make a mark on a surface upon which said roller is rolled upon, said enlarged openings being sized to enable a cap to be received therein and to cover a respective writing tip;

a handle member secured within said receiving grooves; and a pair of retainer clips wherein each retainer clip is secured over a respective receiving groove in order to secure said pair of roller housing elements together.

2. The construction device as defined in claim 1 and further including an indicia mark on a side of said roller.

3. The construction device as defined in claim 1 wherein said marking instruments are self contained ink felt-tip markers.

4. The construction device as defined in claim 3 wherein said felt tip markers are of different colors.

5. The construction device as defined in claim 1 wherein a circumference of said roller is 12, 16, 19 3/16 or 24 inches.

6. The construction device as defined in claim 1 wherein each channel has a spring positioned therein in order to bias said marking instrument toward said enlarged opening.

* * * * *